US006711817B2

(12) United States Patent
Kotani

(10) Patent No.: US 6,711,817 B2
(45) Date of Patent: Mar. 30, 2004

(54) HYPOID RING GEAR FOR DIFFERENTIALS AND METHOD OF PRODUCING THE SAME

(76) Inventor: Seiichi Kotani, 92-1, Nakanocho, Kasai-shi, Hyogo-ken (JP)

( * ) Notice: Subject to any disclaimer, the term of this patent is extended or adjusted under 35 U.S.C. 154(b) by 88 days.

(21) Appl. No.: 09/778,499

(22) Filed: Feb. 7, 2001

(65) Prior Publication Data

US 2001/0005938 A1 Jul. 5, 2001

Related U.S. Application Data

(63) Continuation of application No. 09/417,427, filed on Oct. 13, 1999, now abandoned.

(30) Foreign Application Priority Data

Jul. 13, 1999 (JP) ..... 11-199327
Aug. 16, 1999 (JP) ..... 11-229956

(51) Int. Cl.[7] ..... B23P 15/00

(52) U.S. Cl. ..... 29/893.3; 29/893.34; 29/893.36; 72/67; 72/115

(58) Field of Search ..... 29/893.3, 893.32, 29/893.33, 893.34, 893.36; 72/67, 115; 74/458, 462

(56) References Cited

U.S. PATENT DOCUMENTS 4,798,077 A * 1/1989 Douglas
4,856,167 A * 8/1989 Sabroff
4,949,456 A * 8/1990 Kovach et al. ..... 29/893.35
5,620,075 A * 4/1997 Larsen et al. ..... 192/53.34

* cited by examiner

*Primary Examiner*—I. Cuda Rosenbaum
(74) *Attorney, Agent, or Firm*—J. C. Patents

(57) ABSTRACT

The invention is intended to reduce the installation cost and running cost, minimize the production cost and increase the tooth surface strength of hypoid teeth.

To this end, a hypoid ring gear for differential is produced by the steps of upset-forging a round bar blank heated to a predetermined temperature to form a first disk-like intermediate article, die-forging said first intermediate article to form a second intermediate article in the form of a bottom-closed annular body which is smaller in inner and outer diameters and larger in axial thickness than the end product, punching out the bottom of said second intermediate article to form a third intermediate article in the form of a bottom-opened annular body which is smaller in inner and outer diameters and larger in axial thickness than the end product, shot-blasting said third intermediate article to remove the scale and reheating it to a predetermined temperature and ring-rolling it to form a fourth intermediate article in the form of a crude product which is somewhat smaller in inner and outer diameters and somewhat larger in axial thickness than the end product, orbitally forging said fourth intermediate article to form a fifth intermediate article having hypoid teeth formed therein by orbital forging, and normalizing and shot-blasting said fifth intermediate article to effect normalization and scale removal and then punching out the inner burr which is formed on said fifth intermediate article during tooth forming operation based on orbital forging and cold-coining it, thereby forming the end product.

6 Claims, 4 Drawing Sheets

HYPOID RING GEAR FOR DIFFERENTIALS AND METHOD OF PRODUCING THE SAME

CROSS REFERENCE

This application is a continuation application of, and claims the priority benefit of, U.S. application Ser. No. 09/417,427 filed on Oct. 13, 1999 now abandoned.

BACKGROUND OF THE INVENTION

The present invention relates to a hypoid ring gear for FR (front engine rear drive) vehicle differentials and a method of producing the same.

This type of hypoid ring gear for differentials (hereinafter referred to as the hypoid ring gear) has heretofore been produced, as shown in FIG. 6, by heating a round rod blank A1, upset-forging it to form a first disk-like intermediate article A2, die-forging said first intermediate article A2 to form a second intermediate article A3 in the form of a bottom-closed annular body having substantially the same inner and outer diameters as the end product, punching out the bottom A3' of said second intermediate article A3 to form a third intermediate article A4 in the form of a bottom-opened annular body, normalizing and shot-blasting said third intermediate article A4, lathing said third intermediate article A4 as by an NC lathe to form a fourth intermediate article A5 in the form of a crude product, roughly gear-cutting said fourth intermediate article A5 on a Gleason gear cutting machine for rough machining, and finish-gear-cutting it on a Gleason gear cutting machine for finish machining, thereby providing an end product A6 having hypoid teeth g cut therein.

Since the conventional method of producing hypoid ring gears includes the step of directly die-forging the first disk-like intermediate article A2 to form said second intermediate article A3 in the form of a bottom-closed annular body having substantially the same inner and outer diameters as the end product A6, it needs a large-sized forge press. Besides this, it has to use two expensive Gleason gear cutting machines for cutting hypoid teeth g, thus presenting the drawback of the installation cost being very high. Further, since hypoid teeth g are formed by cutting, there are drawbacks in that the allowance for cutting (the amount to be lathed and the amount to be cut for tooth formation) increases, thus not only decreasing the yield of material but also prolonging the cutting time, thereby increasing the running cost.

Further, a hypoid ring gear produced by the conventional method has its hypoid teeth g formed by cutting, with the result that the flow of metal in the hypoid teeth g has been cut away by the cutter, thus decreasing the tooth surface strength. Therefore, a larger hypoid ring gear is required for transmission of a heavier load, thus presenting the drawback that the differential has to be increased in size.

SUMMARY OF THE INVENTION

The present invention has been proposed with the above drawback in the prior art in mind, and its object is to provide a hypoid ring for differentials and a method of producing the same, which are capable of reducing the installation cost and the running cost, minimizing the production cost and improving the tooth surface strength of the hypoid gear.

To achieve said object, the invention provides a method of producing hypoid ring gears for differentials, comprising the steps of upset-forging a round bar blank heated to a predetermined temperature to form a first disk-like intermediate article, die-forging said first intermediate article to form a second intermediate article in the form of a bottom-closed annular body which is smaller in inner and outer diameters and larger in axial thickness than the end product, punching out the bottom of said second intermediate article to form a third intermediate article in the form of a bottom-opened annular body which is smaller in inner and outer diameters and larger in axial thickness than the end product, shot-blasting said third intermediate article to remove the scale and then reheating it to a predetermined temperature and ring-rolling it to form a fourth intermediate article in the form of a crude product which is somewhat smaller in inner and outer diameters and somewhat larger in axial thickness than the end product, orbitally forging said fourth intermediate article to form a fifth intermediate article having hypoid teeth formed therein by orbital forging, normalizing and shot-blasting said fifth intermediate article to effect normalization and scale removal, punching out the internal burr formed on said fifth intermediate article during tooth forming operation based on orbital forging, and cold-coining it to form an end product.

DESCRIPTION OF THE PREFERRED EMBODIMENTS

Figure 1:
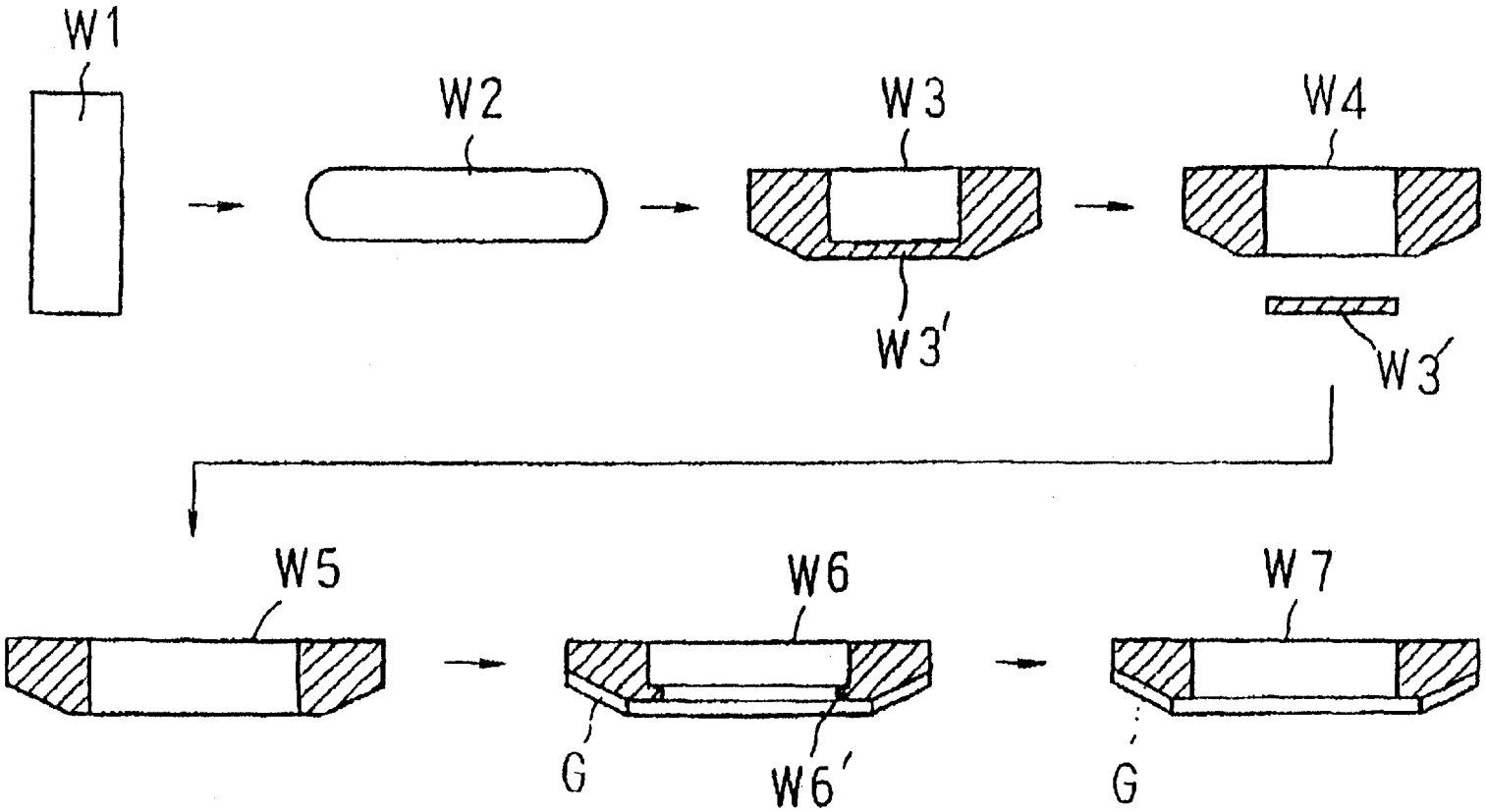
FIG. 1 is a view explaining a process for producing hypoid ring gears for differentials according to the present invention.

FIG. 1 is a process-explanatory view showing a method of producing hypoid ring gears according to the present invention. The method of producing hypoid ring gears according to the invention includes the steps of first heating a round bar blank W1 cut to a fixed length to a predetermined temperature (e.g., 1,200° C.) by an induction heater, and upset-forging it by a forge press to form a first disk-like intermediate article W2. Then follows the step of die-forging said first intermediate article W2 by a forge press to form a second intermediate article W3 in the form of a bottom-closed annular body which is smaller in inner and outer diameters and larger in axial thickness than the end product. Then follows the step of punching out the bottom W3' of said second intermediate article W3 by a forge press to form a third intermediate article W4 in the form of a bottom-opened annular body which is smaller in inner and outer diameters and larger in axial thickness than the end product. Then follows the step of shot-blasting said third intermediate article W4 to remove the scale and then reheating said third intermediate article W4 to a predetermined temperature (e.g. 900–950° C.) by an induction heater and ring-rolling it by a ring-rolling machine to form a fourth intermediate article W3 in the form of a crude product which is somewhat smaller in inner and outer diameters and somewhat larger in axial thickness than the end product. Then follows the step of orbitally forging said fourth intermediate article W5 by an orbital forging machine to form a fifth intermediate article W6 having hypoid teeth G formed therein by orbital forging. Then follows the step of normalizing and shot-blasting said fifth intermediate article W6 to effect normalization and scale removal and then punching out by a punching machine the internal burr W6' formed on said fifth intermediate article W6 during tooth forming operation based on orbital forging, and cold-coining it to form the end product W7.

Figure 2:
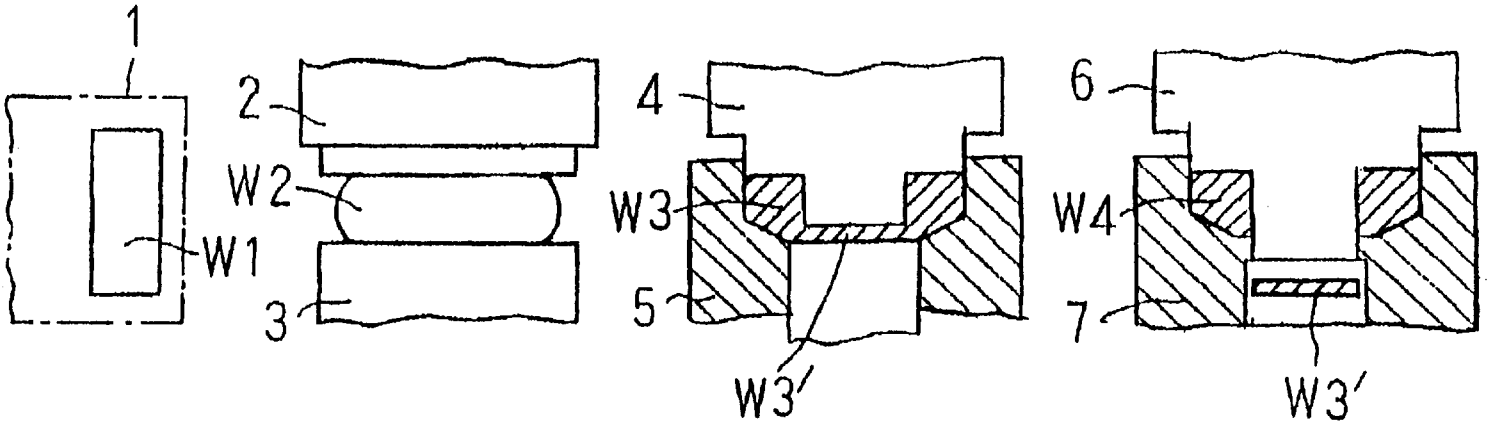
FIG. 2 is a schematic explanatory view of a forge press used in the invention.

The aforesaid forge press comprises a plurality of equispaced punches and dies operatively associated with each other to perform their forming operation, with a transfer feeder used to feed parts to be forged successively to one operating position of the punch and die. Thus, as shown in FIG. 2, a round bar blank W1 heated to a predetermined temperature by an induction heater 1 is upset-forged using an upsetting set of punch 2 and die 3 to form a first disk-like intermediate article W2. This first intermediate article W1 is die-formed by a punch 4 and a die 5 which are smaller in inner and outer diameters than the end product to form a second intermediate article W3 in the form of a bottom-closed annular body which is smaller in inner and outer diameters and larger in axial thickness than the end product. The bottom W3' of the second intermediate article W3 is punched out by a punching-out set of punch 6 and die 7 to form a third intermediate article W4 in the form of a bottom-opened body which is smaller in inner and outer diameters and larger in axial thickness than the end product.

Figure 3:
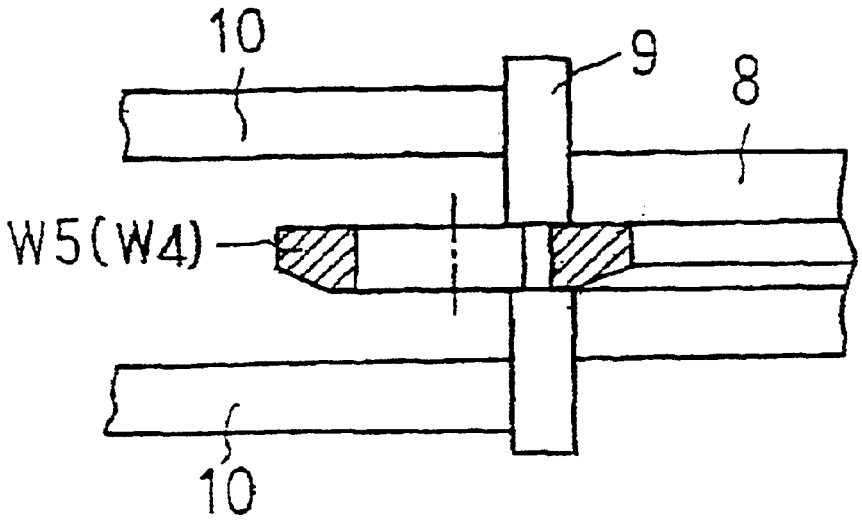
FIG. 3 is a schematic explanatory view of a rolling machine used in the invention.

The aforesaid rolling machine, as shown in FIG. 3, comprises a forming roll 8 supported for being driven for rotation and having on its inner peripheral surface a shape which is the same as the outer peripheral shape of the fourth intermediate article W5, a mandrel 9 supported for rotation and for radial slide movement and having on its outer peripheral surface a shape which is the same as the inner peripheral shape of the fourth intermediate article W5, and a pair of mandrel support rolls 10 for the radial sliding under pressure of the mandrel 9 through a pressure applying means (not shown), wherein with the third intermediate article W4 held between the forming roll 8 and the mandrel 9, the forming roll 8 is rotated to cause the contact rotation of the third intermediate article W4 while the mandrel 9 is radially slid under pressure by the mandrel support rolls 10 to apply a radial holding pressure to the third intermediate article W4, whereby the latter is ring-rolled by the forming roll 8 and mandrel 9 to form the forth intermediate article W5 which is somewhat smaller in inner and outer diameters and somewhat larger in axial thickness than the end product.

Figure 4:
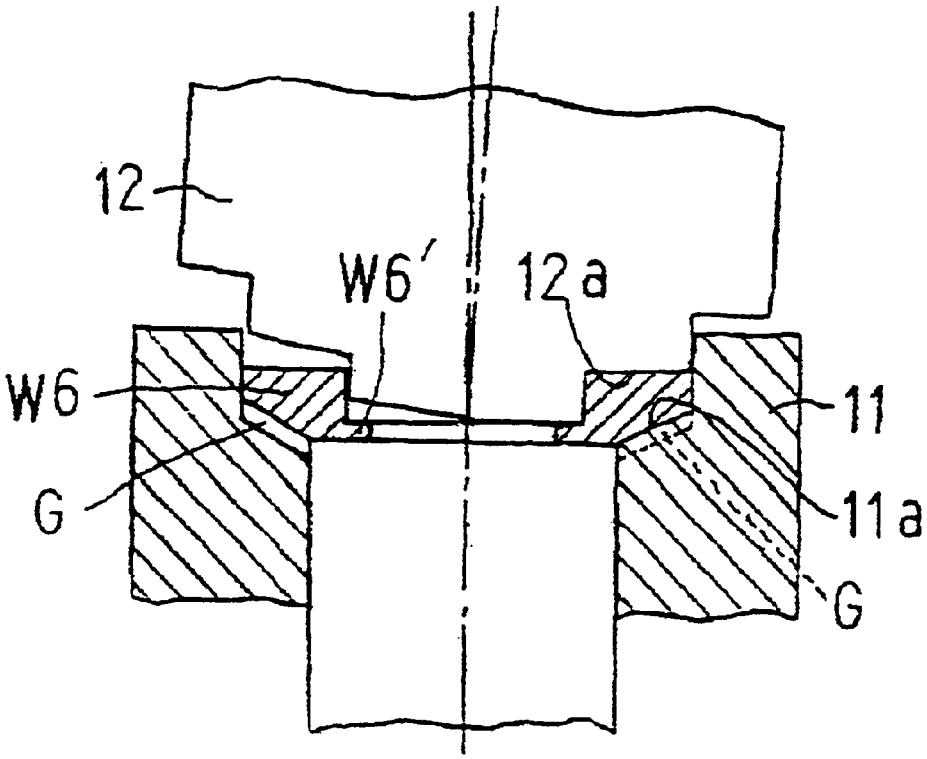
FIG. 4 is a schematic explanatory view of an orbital forging machine used in the invention.

The aforesaid orbital forging machine, as shown in FIG. 4, comprises a pressure-forming die 11 having a pressure-forming surface 11*a* conforming in outer shape to the end product and installed so that it can be raised and lowered by pressure applying means (not shown), and a punch 12 having a conical pressing surface 12*a* and adapted to be rotated while orbiting along a circumference with its center axis included with respect to the center axis of the pressure-forming die 11, the arrangement being such that with the fourth intermediate article W5 fed into the pressure-forming die 11 and with the punch 12 rotating while orbiting along a circumference, the pressure-forming die 11 is raised to urge the fourth intermediate article W5 against the pressing surface 12*a* of the punch 12, whereupon the punch 12 locally urges the fourth intermediate article W5 greater against the pressure-forming surface 11*a* of the pressure-forming die 11 to progressively circumferentially press it, thereby leaving the impression of the pressure-rolling surface 11*a* of the pressure-forming die 11 on the fourth intermediate article W5, thus forming the fifth intermediate article W6 having hypoid teeth G formed therein by orbital forging.

Figure 5:
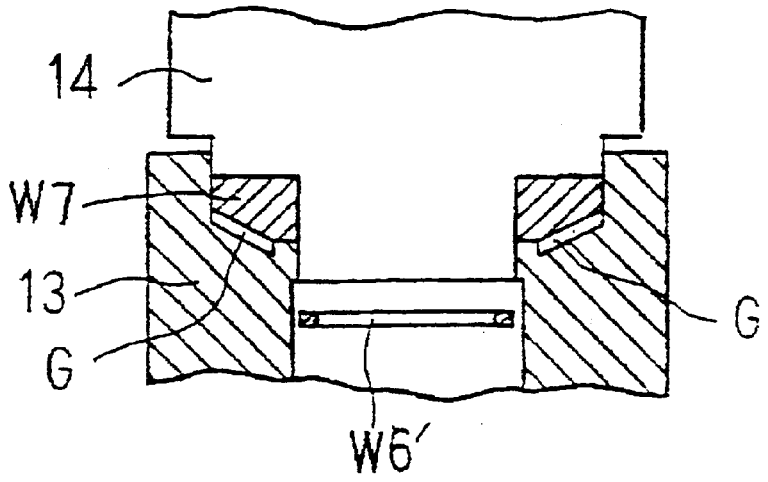
FIG. 5 is a schematic explanatory view of a punching machine used in the invention.
Figure 6:
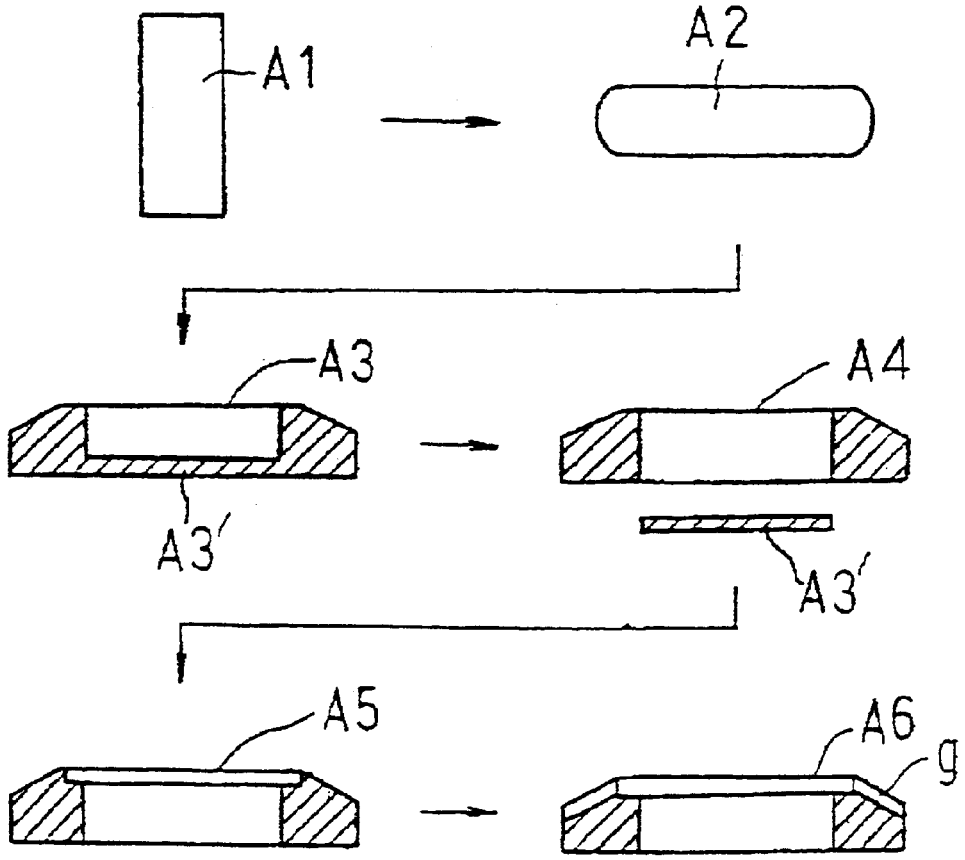
FIG. 6 (PRIOR ART)
FIG. 6 is a view explaining the conventional process for producing hypoid ring gears for differentials.

The aforesaid punching machine, as shown in FIG. 5, comprises a die 13 having an inner shape conforming in outer shape to the end product and a punch 14 having a diameter which is the same as the inner diameter of the end product, the arrangement being such that the punch 14 is urged into the fifth intermediate article W6 fed into the die 13, whereby the fifth intermediate article W6 has its inner burr W6', which is formed thereon during tooth forming operation based on orbital forging, punched out by the punch 14 and is cold-coined to provide the end product W7.

The hypoid ring gear producing method of the present invention includes the steps of forming the first disk-like intermediate article W2 into the second intermediate article W3 in the form of a bottom-closed body which is smaller in inner and outer diameters and larger in axial thickness than the end product, punching out the bottom W3' of the second intermediate article W3 while securing the condition in which the inner and outer diameters are smaller than those of the end product and the axial thickness is larger than that of the end product, and ring-rolling it to form the fourth intermediate article W5 in the form of a crude product which is somewhat smaller in inner and outer diameters and somewhat larger in axial thickness than the end product; therefore, the large-sized forge press is no longer necessary and the installation cost can be reduced. Further, the hypoid teeth G are generated by locally pressing the pressure-forming surface 11*a* of the pressure-forming die 11 against the fourth intermediate article W5 so as to circumferentially and progressively press the press-rolling surface 11*a* of the pressure-forming die 11 against the fourth intermediate article W5, thereby leaving the impression of the pressure-rolling surface 11*a* of the pressure-forming die 11 on the fourth intermediate article W5; therefore, as compared with the conventional tooth cutting using two Gleason gear cutting machines, the installation cost can be reduced while increasing the yield of material and reducing the processing time and the running cost.

Further, since the hypoid ring gear produced by the present production method has hypoid teeth G formed by orbital forging, the hypoid teeth G are formed with flow of grains extending along the tooth surface, so that the tooth surface strength is considerably increased as compared with that of hypoid teeth formed by cutting. Thus, a heavier load can be transmitted with a smaller hypoid gear, so that size-reduction of the differential is possible. Furthermore, as compared with the case of cutting teeth by a Gleason gear-cutting machine, the processing time can be reached and so can be the running cost.

As has been described so far, according to the present invention, it is possible to provide a method of producing hypoid ring gears which is capable of decreasing the installation cost and running cost and minimizing the production cost, and to provide a hypoid ring gear having the tooth surface strength of the hypoid teeth increased to the extent of enabling the differential to be reduced in size.

What is claimed is:

1. A method of producing hypoid ring gears for differentials, comprising the steps of upset-forging a round bar blank heated to a predetermined temperature to form a first disk-like intermediate article, die-forging said first intermediate article to form a second intermediate article in the form of a bottom-closed annular body which is smaller in inner and outer diameters and larger in axial thickness than the end product, punching out the bottom of said second intermediate article to form a third intermediate article in the form of a bottom-opened annular body which is smaller in inner and outer diameters and larger in axial thickness than the end product, shot-blasting said third intermediate article to remove the scale and reheating it to a predetermined temperature and ring-rolling it to form a fourth intermediate article in the form of a crude product which is somewhat smaller in inner and outer diameters and somewhat larger in axial thickness than the end product, orbitally forging said fourth intermediate article to form a fifth intermediate article having hypoid teeth formed therein, and normalizing and shot-blasting said fifth intermediate article to effect normalization and scale removal and then punching out any inner burr which is formed on said fifth intermediate article during tooth forming operation based on orbital forging and then cold-coining it, thereby forming the end product.

2. A method of producing hypoid ring gears for differentials comprising:

providing an annular crude product slightly smaller in inner and outer diameters and slightly larger in axial thickness than an end product;

orbitally forging the crude product to form an intermediate article having hypoid teeth formed therein; and deburring and cold-coining the intermediate article to form the end product.

3. A method according to claim 2, wherein prior to the orbital forging, an annular blank smaller in inner and outer diameters and larger in axial thickness than the end product is subjected to ring-rolling to form the crude product.

4. A method of producing hypoid ring gears for differentials according to claim 3, further comprising the steps of upset-forging a round bar blank heated to a predetermined temperature to form a first disk-like intermediate article;

die-forging said first intermediate article to form a second intermediate article in the form of a bottom-closed annular body which is smaller in inner and outer diameters and larger in axial thickness than the end product;

punching out the bottom of said second intermediate article to form a third intermediate article in the form of a bottom-opened annular body which is smaller in inner and outer diameters and larger in axial thickness than the end product;

shot-blasting said third intermediate article to remove the scale and reheating it to a predetermined temperature and ring-rolling it to form said annular crude product.

5. A method of producing hypoid ring gears for differentials according to claim 3, further comprising:

providing a bottom-opened annular body which is smaller in inner and outer diameters and larger in axial thickness than the end product;

heating the bottom-opened annular body to a predetermined temperature and ring-rolling the bottom-opened annular body to form the annular crude product.

6. A method of producing hypoid ring gears for differentials according to claim 7, further comprising:

providing a disk-like intermediate article;

die-forging said disk-like intermediate article to form a bottom-closed annular body which is smaller in inner and outer diameters and larger in axial thickness than the end product; and punching out the bottom of said bottom-closed annular body to form the bottom-opened annular body.

* * * * *